US007128482B2

(12) United States Patent
Meyerhofer et al.

(10) Patent No.: US 7,128,482 B2
(45) Date of Patent: Oct. 31, 2006

(54) MULTI-MEDIA GAMING PRINTER

(75) Inventors: Eric Meyerhofer, Oceanside, CA (US); Oleg Dymovsky, Los Angeles e, CA (US); Mark Meyerhofer, La Canada, CA (US); John Hilbert, Torrance e, CA (US)

(73) Assignee: FutureLogic, Inc., Glendale, CA (US)

( * ) Notice: Subject to any disclaimer, the term of this patent is extended or adjusted under 35 U.S.C. 154(b) by 0 days.

(21) Appl. No.: 10/661,364

(22) Filed: Sep. 12, 2003

(65) Prior Publication Data

US 2004/0136764 A1 Jul. 15, 2004

Related U.S. Application Data

(60) Provisional application No. 60/410,328, filed on Sep. 12, 2002.

(51) Int. Cl.
*B41J 11/00* (2006.01)

(52) U.S. Cl. ..... 400/124.08; 400/82; 347/173

(58) Field of Classification Search ..... 400/82, 400/124.08, 124.09, 149; 347/172, 173
See application file for complete search history.

(56) References Cited

U.S. PATENT DOCUMENTS

| | | | | |
|---|---|---|---|---|
| 3,947,691 | A * | 3/1976 | Goldstein | 250/566 |
| 4,168,845 | A * | 9/1979 | Oeda et al. | 503/209 |
| 4,519,600 | A * | 5/1985 | Warwick et al. | 271/4.01 |
| 5,067,832 | A * | 11/1991 | Baur et al. | 400/66 |
| 5,119,108 | A * | 6/1992 | Hatakeyama | 347/211 |
| 5,122,754 | A * | 6/1992 | Gotaas | 324/676 |
| 5,266,781 | A * | 11/1993 | Warwick et al. | 235/375 |
| 5,326,179 | A * | 7/1994 | Fukai et al. | 400/521 |
| 5,330,274 | A * | 7/1994 | Schimmelpfennig et al. | 400/82 |
| 5,426,285 | A * | 6/1995 | Sherrod | 235/449 |
| 5,448,284 | A | 9/1995 | Matsuda et al. | 347/221 |
| 5,452,959 | A * | 9/1995 | Oka | 400/149 |
| 5,594,233 | A * | 1/1997 | Kenneth et al. | 235/492 |
| 5,714,743 | A | 2/1998 | Chiba et al. | 235/449 |
| 5,748,737 | A * | 5/1998 | Daggar | 705/41 |
| 5,768,143 | A | 6/1998 | Fujimoto | 700/235 |
| 5,814,796 | A * | 9/1998 | Benson et al. | 235/375 |
| 5,882,127 | A * | 3/1999 | Amano | 400/521 |
| 5,974,961 | A * | 11/1999 | Kazo et al. | 101/4 |
| 6,030,474 | A | 2/2000 | Isono et al. | 156/64 |
| 6,104,311 | A * | 8/2000 | Lastinger | 340/10.51 |
| 6,106,173 | A * | 8/2000 | Suzuki et al. | 400/120.02 |
| 6,147,605 | A * | 11/2000 | Vega et al. | 340/572.7 |
| 6,151,037 | A * | 11/2000 | Kaufman et al. | 347/2 |
| 6,152,620 | A | 11/2000 | Ozawa et al. | 400/120.01 |
| 6,230,973 | B1 | 5/2001 | Fukui et al. | 235/449 |

(Continued)

FOREIGN PATENT DOCUMENTS

| | | | |
|---|---|---|---|
| JP | 58118288 | A * | 7/1983 |

(Continued)

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

A multi-media gaming printer. The multi-media printer may accept various kinds of voucher media, such as thermally writable medias, smart cards, or magnetic strip cards. The multi-media printer includes writing, reading, and erasing devices within the printer to manage and use the different types of media. In addition, the multi-media printer includes control logic and articulated printing mechanisms that prevent the multi-media printer from inadvertently manipulating a voucher in an inappropriate manner. The design of the multi-media printer is modular so that voucher media magazines may be replaced as needed.

5 Claims, 11 Drawing Sheets

U.S. PATENT DOCUMENTS

| | | | | |
|---|---|---|---|---|
| 6,236,420 | B1 * | 5/2001 | Matsuzaka | 347/170 |
| 6,313,856 | B1 * | 11/2001 | Ulrich | 347/171 |
| 6,364,550 | B1 * | 4/2002 | Petteruti | 400/88 |
| 6,543,685 | B1 | 4/2003 | Lien et al. | 235/380 |
| 6,694,884 | B1 | 2/2004 | Klinefelter et al. | 101/484 |
| 6,698,654 | B1 * | 3/2004 | Zuppicich | 235/380 |
| 6,729,719 | B1 * | 5/2004 | Klinefelter et al. | 347/101 |
| 6,758,616 | B1 * | 7/2004 | Pribula et al. | 400/624 |
| 2001/0014246 | A1 * | 8/2001 | Luciano et al. | 400/693 |

FOREIGN PATENT DOCUMENTS

| | | | | |
|---|---|---|---|---|
| JP | 61120776 | A | * | 6/1986 |
| JP | 62089167 | A | | 4/1987 |
| JP | 05169762 | A | * | 7/1993 |
| JP | 10255118 | A | * | 9/1998 |
| JP | 2002086970 | A | * | 3/2002 |

* cited by examiner

MULTI-MEDIA GAMING PRINTER

CROSS-REFERENCE TO RELATED APPLICATIONS

This application claims the benefit of U.S. Provisional Patent Application No. 60/410,328, filed Sep. 12, 2002, the contents of which are hereby incorporated by reference as if stated in full herein. This application is related to U.S. patent application Ser. No. 10/654,521, entitled "REWRITABLE CARD PRINTER", filed Sep. 2, 2003, U.S. patent application Ser. No. 10/640,495, entitled "PAPER MOTION DETECTOR IN A GAMING MACHINE", filed Aug. 12, 2003, U.S. patent application Ser. No. 10/616,811, Entitled "GAMING MACHINE PRINTER", filed Jul. 9, 2003, and U.S. patent application Ser. No. 10/136,897, filed Apr. 30, 2002, the contents of which are hereby incorporated by reference as if stated in full herein.

BACKGROUND OF THE INVENTION

This invention relates generally to gaming printers and more specifically to printers for use in cashless gaming machines that use vouchers.

The gaming machine manufacturing industry provides a variety of gaming machines for the amusement of gaming machine players. An exemplary gaming machine is a slot machine. A slot machine is an electro-mechanical game wherein chance or the skill of a player determines the outcome of the game. Slot machines are usually found in casinos or other more informal gaming establishments.

Gaming machine manufacturers have more recently introduced cashless enabled games to the market and these have begun to find wide acceptance in the gaming industry. Cashless enabled games are so named because they can conduct financial exchanges using a mixture of traditional currencies and vouchers. Typically, a cashless enabled game has a gaming printer to produce vouchers and a voucher reader that supports automatic reading of vouchers. To coordinate the activities of multiple cashless enabled games, one or more cashless enabled games may be electronically coupled to a cashless enabled game system that controls the cashless operations of a cashless enabled game.

When a player cashes out using a cashless enabled game coupled to a cashless enabled game system, the cashless enabled game signals the system and the system may determine the type of pay out presented to the player. Depending on the size of the pay out, the cashless enabled game system may cause the cashless enabled game to present coins in the traditional method of a slot machine, or the cashless enabled game system may cause a gaming printer in the cashless enabled game to produce a voucher for the value of the pay out. The voucher may then be redeemed in a variety of ways. For example, the voucher may be redeemed for cash at a cashier's cage or used with another cashless enabled game. In order to use the voucher in a cashless enabled game, the voucher is inserted into a voucher reader of another cashless enabled game at a participating casino and the cashless enabled game system recognizes the voucher, redeems the voucher, and places an appropriate amount of playing credits on the cashless enabled game.

Cashless enabled games have found an increasing acceptance and use in the gaming industry, both with players who enjoy the speed of play and ease of transporting their winnings around the casino and casinos who have realized significant labor savings in the form of reduced coin hopper reloads in the games, and an increase in revenue because of the speed of play. Practical field experience with printers used in cashless enabled games has illustrated that there are areas for improvement in the current printer designs and implementation. These areas in need of improvement include methods and means for printing and reading images on a variety of media using direct thermal, thermal transfer, smart card, magnetic media, and Radio Frequency technologies, and magazine type loading and unloading containers for new and exhausted media storage and/or replacement.

DEFINITIONS

For the purposes of this document, the following definitions apply:

"Casino"—A casino in the traditional sense, or other place where gambling takes place.

"Slot Machine" or "Slot"—A casino electro-mechanical game of chance. A Slot Machine as it is known is a sub-set of such games.

"Game Voucher"—A media, such as paper, containing sufficient information to identify at a minimum, an amount of money and a validation number use to authenticate the transaction.

"Promotional Voucher"—A media, such as paper, containing sufficient information to identify at a minimum, a promotional event, a promotional reward to the player and validation information.

"Dot Impact Printer"—Also known as "Impact Printers" describe a printer which makes an image by striking an inked ribbon overlaid on plain paper with a small pin which essentially hammers the ink onto the paper to make a small dot. Impact printers, by their electro-mechanical nature, have a number of moving parts and make a characteristic grinding sound, such as the noise made by all older receipt printers.

"Thermal Printers"—A printer where paper with a heat sensitive side is imaged using a print head which applies heat in tiny dots (1/200th of an inch in size or smaller) in order to turn the area black. In this manner, all images are created by a series of tiny black dots. A widely known example of a thermal printer is the original fax machines.

"Thermal Transfer Printers"—A printer where a transfer ribbon is used to create images on the paper. The thermal print head, heats the transfer ribbon, in turn creating an image on the paper.

"Bill Acceptor"—A device which automatically accepts paper currency by scanning it and saving the paper currency within the machine. A coin change machine always has such a device on it, and more recently, so do all slot machines.

"Ticket Image"—The image(s) created on the paper by a common process of imaging dots on the paper.

"Smart Card"—A device that normally takes the form of a credit voucher size and contains electronic circuitry and an interface commonly known as a swipe interface as a means of electrically connecting to a reading device.

"Magnetic Media"—A device containing a magnetic stripe that is programmable and readable by sliding and/or placing the magnetic Stripe adjacent to a interface device, such as the magnetic stripe used on credit vouchers.

"Thermal Media"—A type paper with a heat sensitive side is imaged using a print head which applies heat in tiny dots (1/200th of an inch in size or smaller) in order to turn the area black.

"Thermal Reversible Media"—A type of paper or voucher containing a multi-stable thermal layer. This layer is stable in clear or opaque( black or other colors), depending on the amount of heat applied by the thermal print head.

"RF Fiber Media"—A type of paper or voucher containing Radio Frequency active elements that are grouped together in such a manner so as to provide information about the paper or voucher stock.

"RF ID Tag Media"—A type of paper or voucher containing a Radio Frequency circuit that can hold information and does not require a direct electrical connection as an interface connection.

"Write Once Media"—A definition referring to any media that can only be written on or imaged one time. Standard thermally active paper is an example.

SUMMARY OF THE INVENTION

A multi-media gaming printer is provided. The multi-media gaming printer can be integrated into a cash-less slot machine or promotional system in a casino that produces cash-out paper vouchers and/or print on demand player tracking card/vouchers capable of communicating with a game or a host. A multi-media printer may print, scan, encode magnetically and electronically, and otherwise interface with a wide range of media types.

In one aspect of the invention, The multi-media printer may accept various kinds of voucher media, such as thermally writable medias, smart cards, or magnetic strip cards. The multi-media printer includes writing, reading, and erasing devices within the printer to manage and use the different types of media. In addition, the multi-media printer includes control logic and articulated printing mechanisms that prevent the multi-media printer from inadvertently manipulating a voucher in an inappropriate manner. The design of the multi-media printer is modular so that voucher media magazines may be replaced as needed. In another aspect of the current invention, the multi-media printer contains a means to print and scan the thermal images, not limited to barcodes, created on thermally reactive paper.

In another aspect of the current invention, the multi-media printer contains means to interface to a "smart card" used in slot machines for the convenience of player identification, statistical information, playing credits and banking information In another aspect of the current invention, the multi-media printer contains a means to interface with magnetic media for the convenience of player identification, statistical information, playing credits and banking information.

In another aspect of the current invention, the multi-media printer contains means to interface with thermal reversible media used in slot machines to convey credit amounts and other information of interest to a player of slot machines.

In another aspect of the current invention, the multi-media printer contains a means to interface with RF Fiber Media, the RF Fiber Media consists of radio frequency resonators, or fibers, that are randomly or pseudo-randomly placed on a carrying medium, the medium can be standard thermal paper or other suitable carrying medium, the collection of the resonators placed on the medium in the random manner form a relatively unique signature, the signature can be obtained by applying a electro magnetic signal, the signal typically in the radio frequency spectrum, as the signal is applied, each of the resonators produce a electro magnetic response to the signal, the response is received and the collection of all the responses form the signature, the signature either alone or in combination with other authentication means of game voucher and/or promotional voucher provide a increased certainty of the authentication.

In another aspect of the current invention, the multi-media printer contains a means to interface with RF ID Tag Media, the RF ID Tag Media contains the means to allow information to be written and read electronically, the information is used either alone or in combination with other authentication means of Game Voucher and/or Promotional Voucher provide an increased certainty of the authentication.

In another aspect of the current invention, the multi-media printer contains a means to provide a removable magazine type loading and unloading containers for new and exhausted media storage and/or replacement.

In another aspect of the current invention, the multi-media printer contains a means to provide a removable magazine type loading and unloading containers for new and exhausted thermal transfer ribbons and/or replacement.

In another aspect of the current invention, the multi-media printer contains a means to provide a slide in and slide out mechanism for removable magazine type loading and unloading containers for new and exhausted media storage and/or replacement.

In another aspect of the current invention, the multi-media printer contains a means to provide a slide in and slide out mechanism for removable magazine type loading and unloading containers for new and exhausted thermal transfer ribbons and/or replacement.

In another aspect of the current invention, the multi-media printer contains a means to print on write once media and scan the media to determine its content and write on the media repeatadly until the predefined writing zones are full, and the means to store the media inside of the multi-media printer for later retrieval.

In another aspect of the current invention, the multi-media printer contains a means to store blank write once media and/or other media.

In another aspect of the current invention, the multi-media printer contains a means to retrieve the blank write once media from the storage on demand and to print images on the media as directed by a game or a host.

In another aspect of the current invention, the multi-media printer contains a cleaning system used to clean the print head and thermal reversible, smart card, or write once media. The cleaning system may be internal to the multi-media printer or may be a removable cartridge that can be placed in the multi-media printer for cleaning then removed after cleaning is complete.

In another aspect of the current invention, the multi-media printer contains a means to provide an articulating print head mechanism. The mechanism is used to adjust for the differences in media thickness. The mechanism will automatically adjust to the required thickness of the media, the mechanism is normally held at a distance from the media, until the type of media is identified avoiding damage to the media and to the mechanism.

In another aspect of the current invention, the multi-media printer contains a detection means to identify the type of media that is inserted into the multi-media printer by the player. The detection means may include a smart card detection circuit, using a reader for magnetic media, using a radio frequency circuit for RF ID tag media, using a radio frequency circuit for RF fiber media, using optical scanning and/or thickness measurement for thermal reversable media, and using optical scanning and/or thickness measurement for write once media.

In another aspect of the current invention, the multi-media printer contains an optical scanning or interrogation system.

The interrogation system is used to determine the cleanliness of the media and therefore its suitability for continued use by the multi-media printer. Media determined not to be suitable for continued use is considered exhausted media and is set aside or stored for later retrieval and possible refurbishment by qualified personnel.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
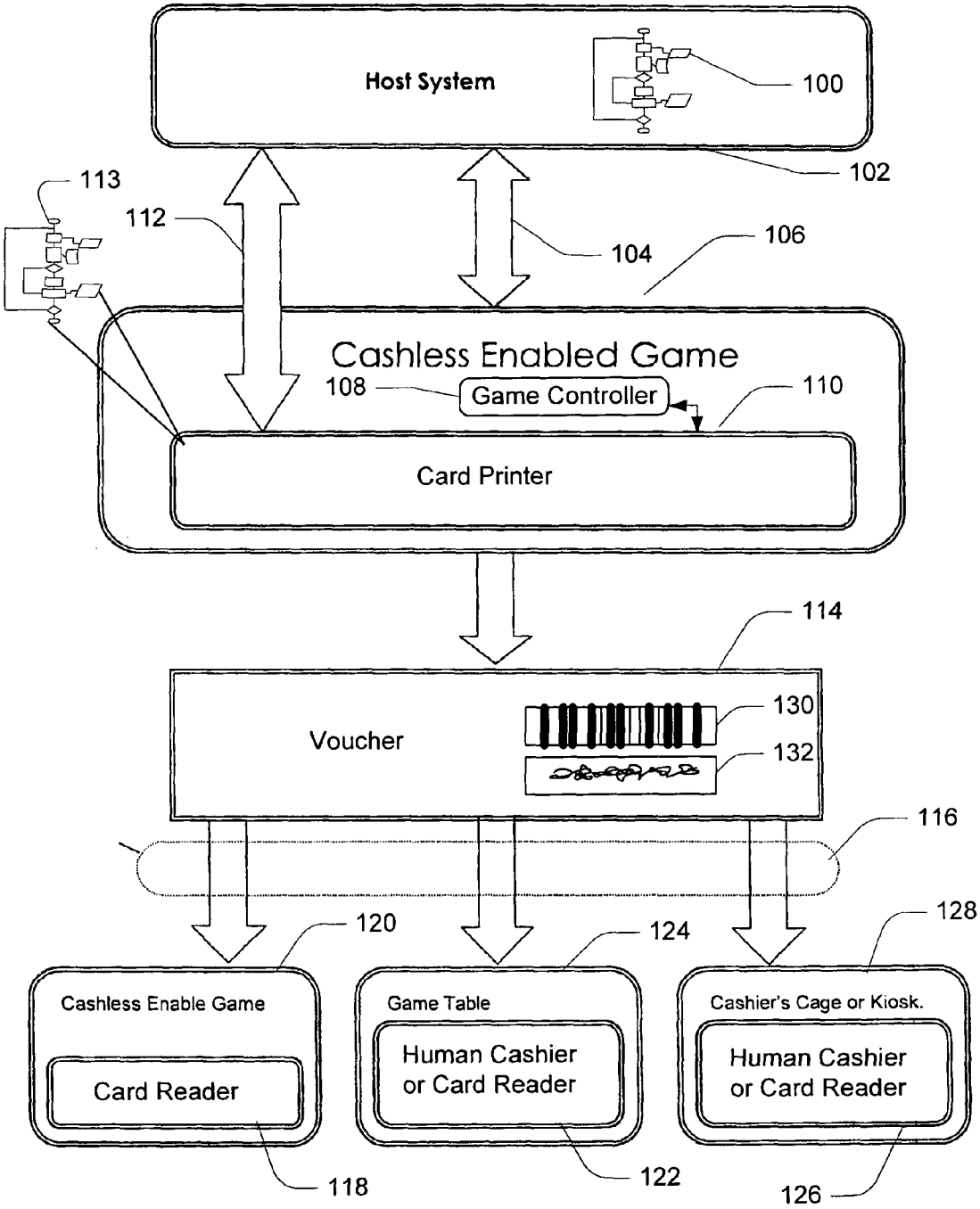
FIG. 1 is a block diagram of a cashless gaming machine and system in accordance with an exemplary embodiment of the present invention.

FIG. 1 is a block diagram of a cashless enabled gaming machine coupled to a multi-media printer in accordance with an exemplary embodiment of the present invention. A cashless gaming system includes a cashless gaming system controller 100 hosted by a system host 102 coupled (104) to one or more cashless enabled games 106. A cashless enabled game includes a game controller 108 that controls the operation of the cashless enabled game. The game controller is coupled to a multi-media printer 110. The cashless enabled game uses the multi-media printer to write voucher media such as voucher 114. The multi-media printer includes media identification and printing algorithms 113 used in conjunction with vouchers. The voucher includes the cash-out information for a player.

The multi-media printer may also be coupled (112) to the host system and cashless gaming controller. The voucher may be redeemed (116) in a variety of ways. The voucher may be redeemed by a human cashier or voucher reader 122 at a game table 124, or a human cashier or voucher reader 126 at a cashier's cage or kiosk 128, or by a voucher reader 118 at another cashless enabled game 120. Redemption is only possible after the voucher passes a verification of account information 130 and validation using security features 132 included in the voucher.

Figure 2A:
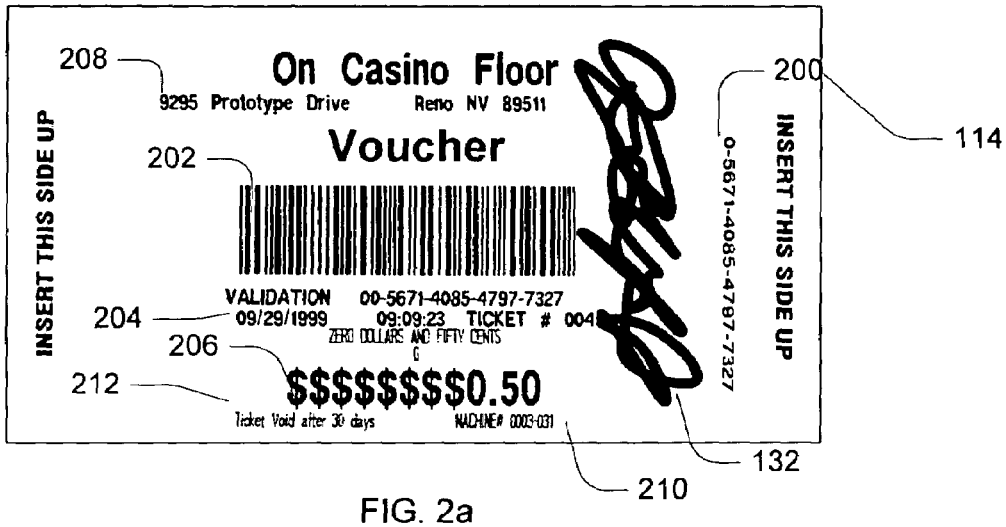
FIG. 2*a* is an illustration of a voucher in accordance with an exemplary embodiment of the present invention.

FIG. 2*a* is an illustration of a voucher in accordance with an exemplary embodiment of the present invention. The voucher shown is produced from commands issued by the cashless enabled game to the gaming printer in response to a player's request to cash-out. The voucher 114 includes features such as a validation number, printed in both a human readable form such as a character string 200 and in a machine-readable form such as a bar code 202, time and date stamps 204, cash-out amount 206, casino location information 208, cashless enabled game identifier 210, and an indication of an expiration date 212. Included in the voucher is a security feature 132 that may take one or more forms.

In one voucher media in accordance with an exemplary embodiment of the present invention, one face of the voucher includes a layer of writable and erasable thermally sensitive film. The thermal film becomes opaque at one temperature level but becomes transparent at another temperature. This effect can be used to create a thermally rewritable voucher.

Figure 2B:
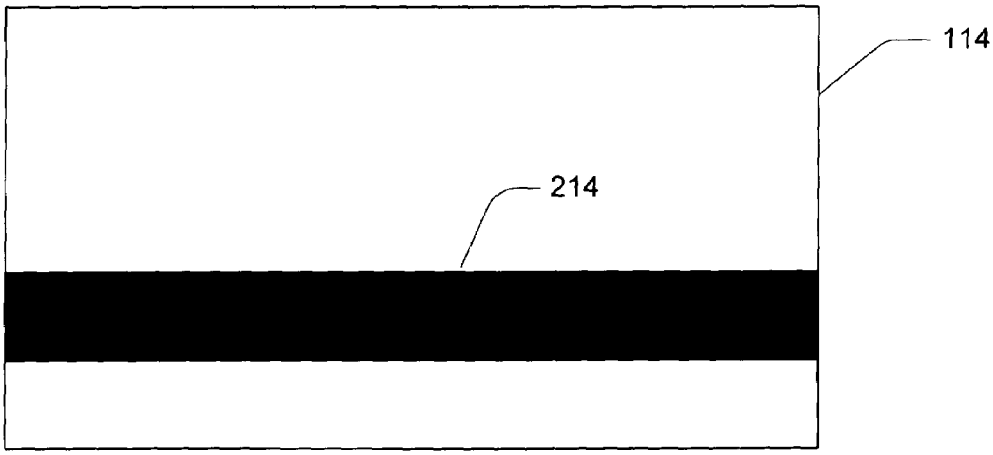
FIG. 2*b* is an illustration of another portion of a voucher in accordance with an exemplary embodiment of the present invention.

FIG. 2*b* is an illustration of another side of a voucher in accordance with an exemplary embodiment of the present invention. The voucher 114 may also include a read/write magnetic strip 214 for encoding of any of the information described above.

In addition, the magnetic strip may be used to transmit information to the multi-media printer. For example, the magnetic strip may encode instructions such as configuration flags or programming instructions used to reconfigure or reprogram the multi-media printer.

Figure 2C:
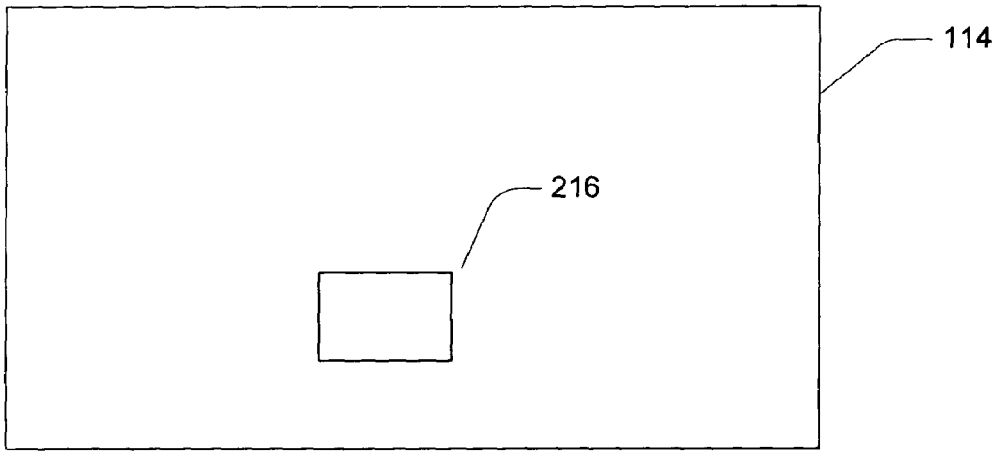
FIG. 2*c* is an illustration of another portion of a voucher having a static memory in accordance with an exemplary embodiment of the present invention.

FIG. 2*c* is an illustration of another portion of a voucher having a static memory in accordance with an exemplary embodiment of the present invention. The voucher 114 may also include a static memory 216 embedded in the voucher so that the voucher can be used as a "smart" card for encoding of any of the information described above.

In addition, the static memory may be used to transmit information to the multi-media printer. For example, the static memory may encode instructions such as configuration flags or programming instructions used to reconfigure or reprogram the multi-media printer.

Figure 3A:
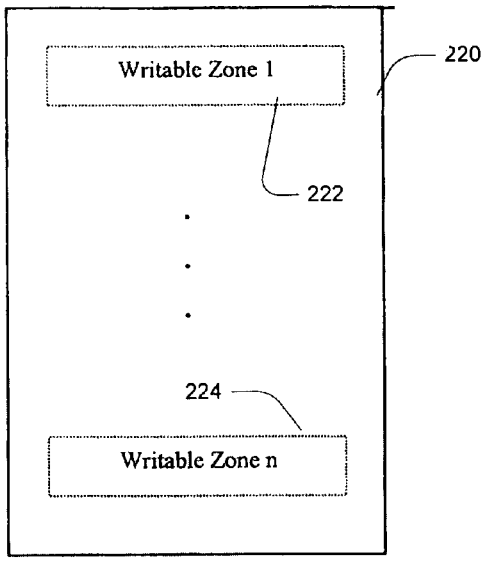
FIGS. 3*a* to 3*d* illustrate a sequence of using a voucher having multiple printing areas in accordance with an exemplary embodiment of the present invention.

FIGS. 3*a* to 3*d* illustrate a sequence of using a voucher having multiple writable zones in accordance with an exemplary embodiment of the present invention. Referring now to FIG. 3*a*, a voucher having multiple writable zones 220 is used to implement multiple rewrite features in a voucher using write once media. The voucher is divided into predetermined writable zones, shown as writable zone 1 222 through writable zone n 224. As the voucher is composed of a write once media, each writable zone may be written to but not erased.

Figure 3B:
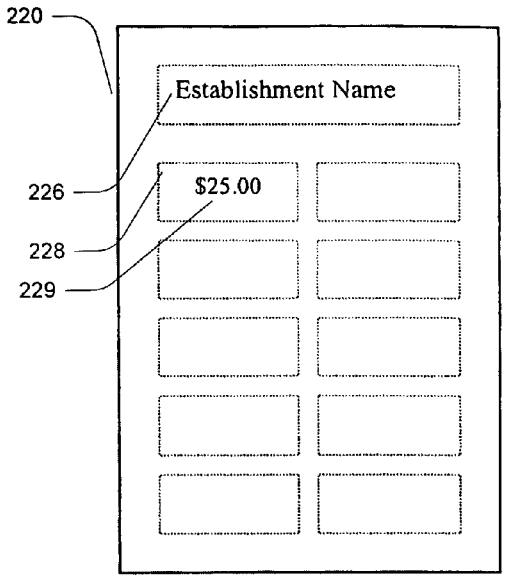

Referring now to FIG. 3*b*, the voucher 220 is shown having a first writable zone 226 having permanent information, such as an establishment's identifier, written into the first writable zone. A second writable zone 228 has a cashout value 229 or other temporary data written to the writable zone. The voucher may now be redeemed or otherwise used within a cashless gaming environment as previously described.

Figure 3C:
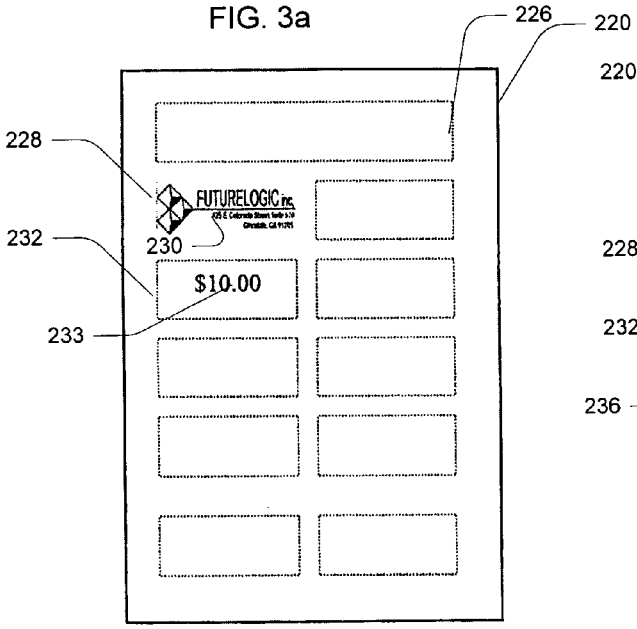

Referring now to FIG. 3*c*, each time the voucher 220 is redeemed, any information in the first rewritable zone 226 is preserved. However, the cashout value or other information printed in the second rewritable is canceled out by printing an obscuring indicia 230 over the information in the second rewritable zone. The next time the voucher is used in a multi-media printer, a next writable zone 232 is detected by the multi-media printer. The next writable zone is then used by the multi-media printer to print a cash-out value or other information 233 as needed.

Figure 3D:
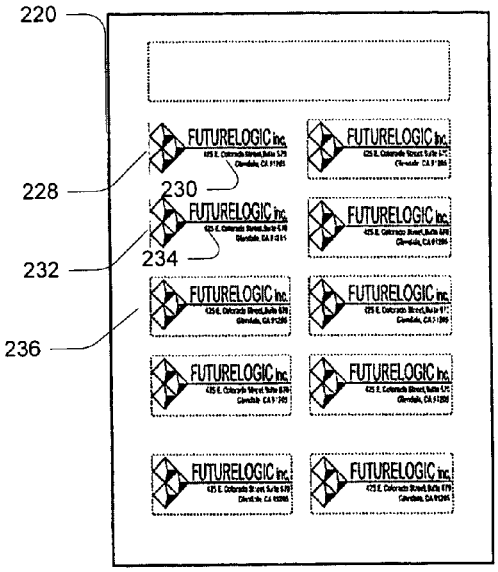

Referring now to FIG. 3*d*, the voucher 220 is shown with each writable zone, such as rewritable zones 228, 232, and 236, filled with obscuring indicia, such as obscuring indica 230 and 234. Once each of the rewritable zones on the voucher or filled with obscuring indicia, the voucher is removed from service by the multi-media printer.

Figure 4A:
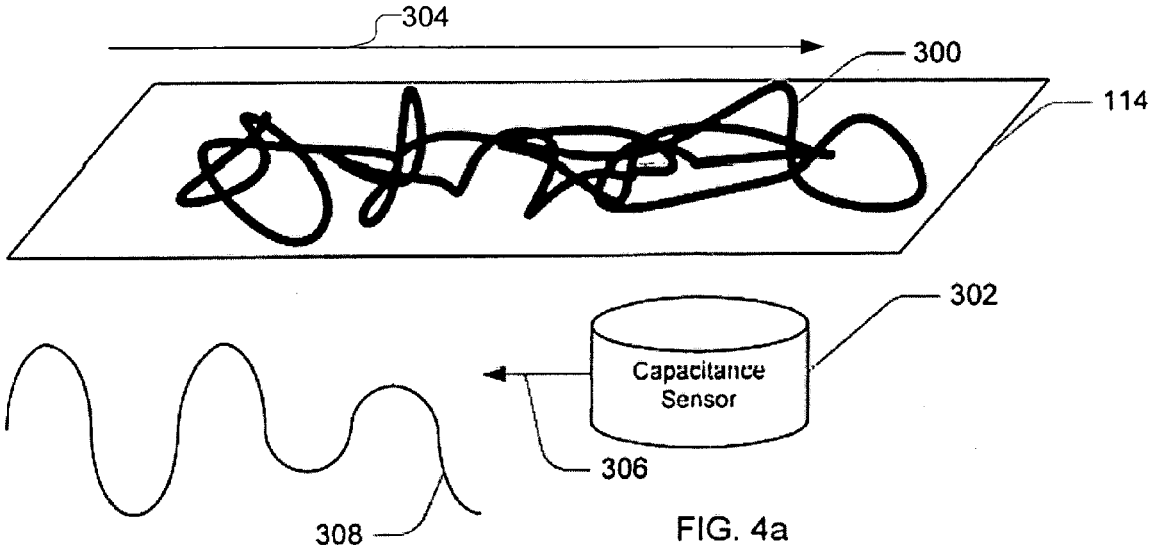
FIG. 4*a* is a block diagram illustrating a security feature employing capacitive inks in accordance with an exemplary embodiment of the present invention.

FIG. 4*a* is a block diagram illustrating a security feature employing capacitive inks in accordance with an exemplary embodiment of the present invention. A voucher 114 may be imprinted with metallic inks to create one or more capacitors in the voucher. The one or more capacitors may be used to create a security feature in the form of a capacitor structure 300 whose capacitance may be detected by a capacitance sensor 302 coupled to the voucher. As the card moves across the sensor (as indicated by arrow 304) the sensor senses changes in the localized capacitance of the card and generates (306) a security signature signal 308 corresponding to the structure of the capacitor structure 300 in the voucher. This security signature signal may be used to identify each voucher used in a cashless enabled gaming system.

Figure 4B:
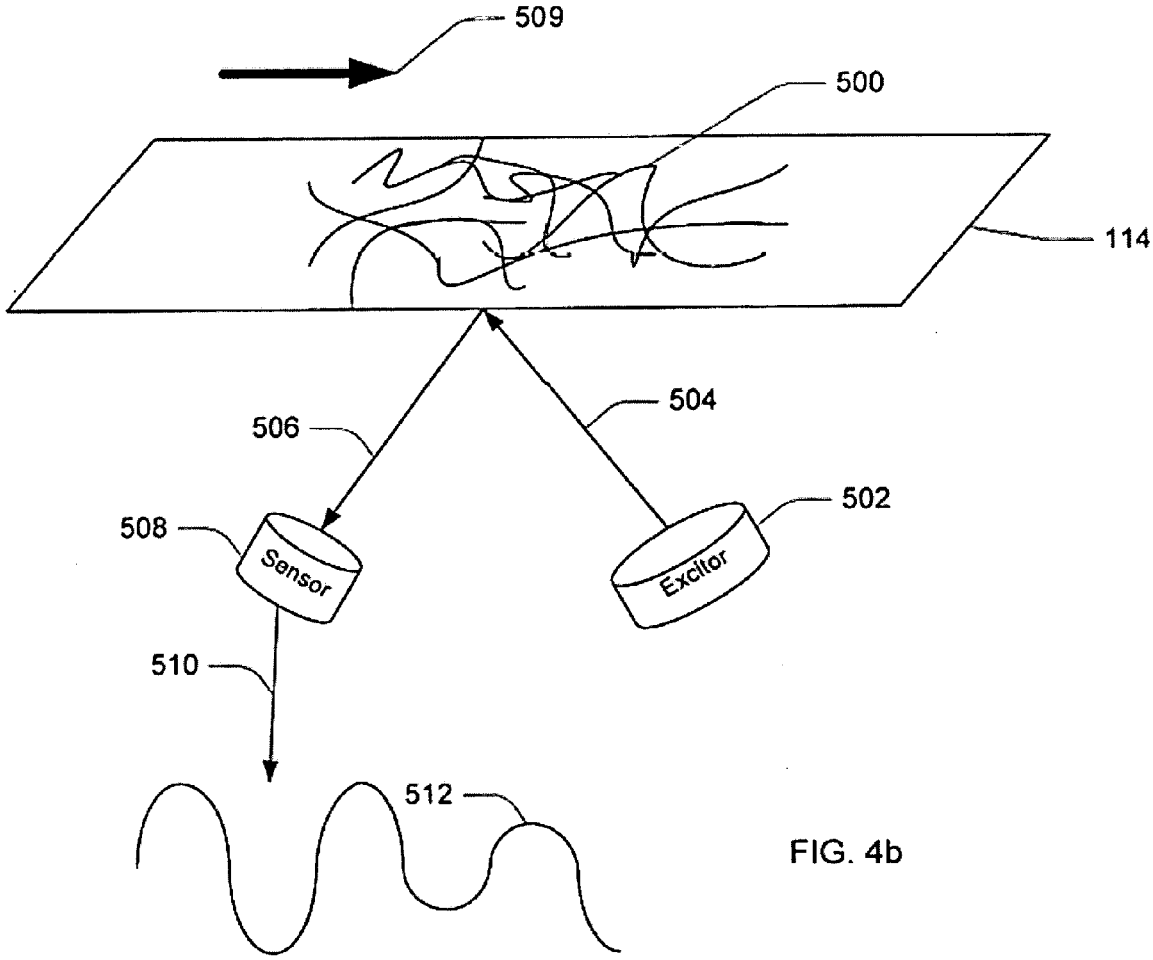
FIG. 4*b* is a block diagram of a security feature using randomly deposited radio sensitive fibers or inks embedded in a voucher in accordance with an exemplary embodiment of the present invention.

FIG. 4*b* is a block diagram of a security feature using randomly deposited radio sensitive fibers or inks embedded in a voucher in accordance with an exemplary embodiment of the present invention. A voucher 114 may include a layer of randomly deposited radio sensitive fibers 500 embedded within the card. An excitor 502 is used to transmit short pulses of radio waves 504 into the layer of fibers. In response to the radio waves, the fibers generate a resultant radio frequency signal 506 that may be detected by a sensor 508. If the voucher is moving (as indicated by direction arrow 509) as the fibers are being excited, the sensor receives a time varying radio frequency signal generated by the excited and moving fibers. In response to the time varying radio frequency signal, the sensor generates (510) a time varying security signature signal 512 that may be used to uniquely identify each voucher in a cashless gaming system.

Figure 5:
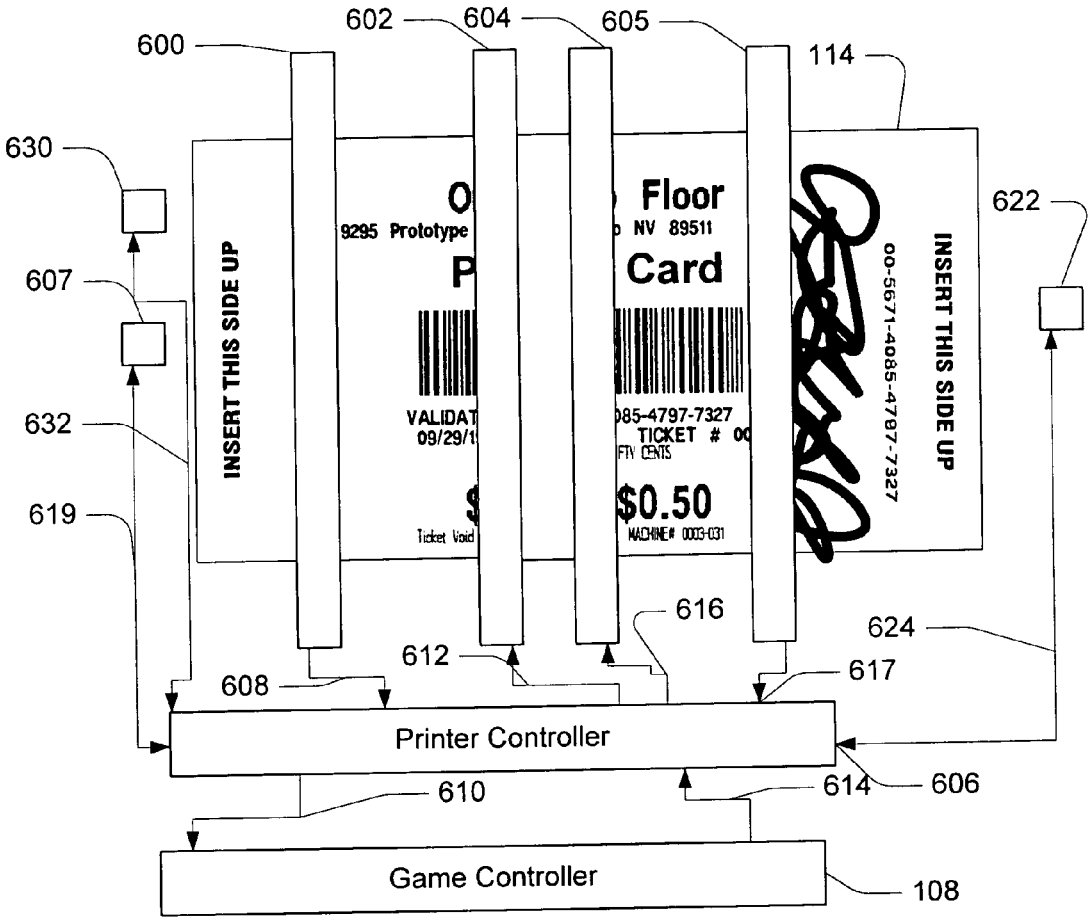
FIG. 5 is a block diagram of the operation of a multi-media printer in accordance with an exemplary embodiment of the present invention.

FIG. 5 is a block diagram of the operation of a multi-media printer in accordance with an exemplary embodiment of the present invention. A multi-media printer includes a security feature reader 600 for reading a security feature embedded in a voucher 114. The type of security feature reader is dependent on the type of security features used with the voucher. The security feature reader supplies the appropriate excitation energy and sensor to generate a security signature signal as previously described.

The multi-media printer also includes an erase head 602 for erasing a voucher prior to printing on the voucher. The erase head raises the temperature of a rewritable thermal film to the erasing temperature and any images previously written to the voucher are erased.

The multi-media printer also includes a print head 604 for printing on the voucher. The print head raises the temperature of the thermal film on the voucher to the writing temperature and indicia are printed onto the voucher as a result.

The multi-media printer also includes an optical scanning device 605 for reading the printed indicia on the voucher. The operation of such a device is more fully detailed in U.S. patent application Ser. No. 10/136,897, filed Apr. 30, 2002, the contents of which are hereby incorporated by reference as if stated herein in full. The optical scanning device may also be used to detect a usable writable zone on a voucher having multiple writable zones 220 (of FIG. 3*a*) by the multi-media printer The multi-media printer also includes a magnetic strip read/write head 607 for reading from, and writing to a magnetic strip 214 (of FIG. 2*b*) on the voucher.

The multi-media printer includes a printer controller 606 operably coupled to the security feature reader. The security feature reader generates a security signature signal 608 that is transmitted to the printer controller.

The printer controller is also coupled to the erase head. The printer controller generates an erase control signal 612 that is transmitted to the erase head. In response to the erase head signal, the erase head heats the voucher until all indicia are erased from the voucher.

The printer controller is also coupled to the print head. The printer controller transmits print head control signals 616 to the print head. In response to the print head control signals, the print head heats a thermal element for each dot that is to be imaged on the voucher.

The printer controller is also coupled to the optical scanner 605. As the optical scanner scans the printed indicia on the voucher, the optical scanner transmits scanned signals 617 to the printer controller.

The printer controller is also coupled to the magnetic strip read/write head 607. The printer controller transmits magnetic strip write signals and receives magnetic strip read signals to and from (619) the magnetic strip read/write head.

The printer controller may also be coupled to a static memory read/write connector 622. The printer controller transmits static memory write signals and receives static memory read signals to and from (624) the static memory read/write head.

The printer controller may also be coupled to a media thickness sensor 630 for measuring the thickness of a voucher inserted into the multi-media printer. The thickness sensor may be a contact device such as a limit switch with multiple trip points or a potentiometer having a lever contacting the voucher, or may employ non-contacting optical, acoustic, or capacitance measurement techniques. The media thickness sensor generates media thickness signals 632 that are transmitted back to the printer controller.

In one embodiment of a multi-media printer in accordance with the present invention, a game controller 108 is operably coupled to the printer controller. The printer controller receives printer control instructions 614, including voucher information for writing to the voucher, from the game controller. The printer controller may also transmit printer status and voucher identification signals 610 to the game controller.

Figure 6:
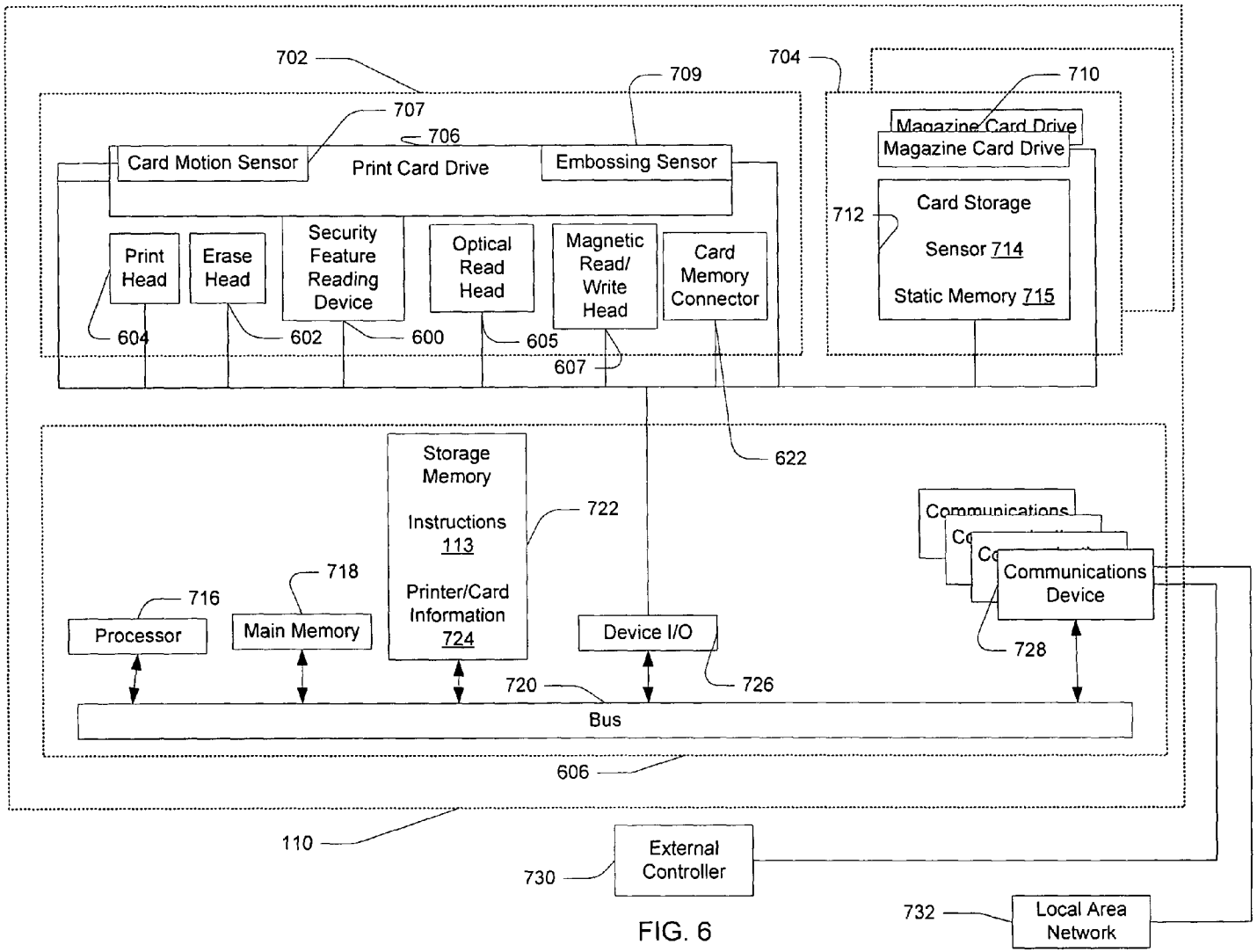
FIG. 6 is an architecture diagram of a multi-media printer employing components having integral controllers in accordance with an exemplary embodiment of the present invention.

FIG. 6 is a block diagram of a multi-media printer in accordance with an exemplary embodiment of the present invention. A multi-media printer 110 includes a printer controller 606, a print module 702, and one or more voucher magazines 704.

The print module includes a print voucher drive 706 that moves vouchers through the print module. The print voucher drive is reversible such that a voucher may be fed through the print module in more than one direction by the print voucher drive. The print voucher drive includes a voucher motion sensor 707 for sensing voucher movement within the print voucher drive. A more detailed discussion of printer media motion detection within a printer is presented in U.S. patent application entitled "PAPER MOTION DETECTOR IN A GAMING MACHINE", Ser. No. 10/640,495 Aug. 12, 2003, the contents of which are hereby incorporated by reference as if stated herein in full. The print drive further includes an embossing detector 709 that may be used to sense when an embossed item, such as a conventional credit voucher, is inserted into the print module. The embossing detector may be a mechanical device, such as a limit switch, that contacts an inserted card and detects any embossing. If an embossed card is inserted into the multi-media printer, the multi-media printer may not attempt to write to the card, only read the card.

The print module further includes a security feature reading device 600 for reading any security features included in the voucher. The print module further includes a print head 604 for writing indicia to the voucher and an erase head 602 for erasing the indicia from the voucher. The print module. The print module further includes an optical scanning device 605 for scanning the indicia printed onto a voucher. The print module further includes a magnetic strip read/write head 607 used to read and write from and to a voucher's magnetic strip. The print module is removably and electronically coupled to the printer controller and removably and mechanically coupled to the voucher magazine.

In operation, the print module receives printer control signals from the printer controller. In response to the printer control signals, the print module scans vouchers for the presence and value of any security feature in the voucher. As the print module scans the voucher, the security feature reading device generates a previously described security signature signal that is transmitted to the printer controller. In addition, the print module thermally prints on the vouchers, and thermally erases the vouchers, under the control of the printer controller. The print module may also receive a voucher from a player and transmit a voucher detection signal to the printer controller.

The print module may also include a static memory read/write connector 622 for coupling to a "smart" card having a readable/writable static memory. The printer controller transmits static memory write signals and receives static memory read signals to and from the static memory read/write head.

The one or more independently controlled voucher magazines store vouchers and provide the vouchers to the printer module on command from the printer controller. Each voucher magazine may include one or more magazine voucher drives 710 for moving vouchers into and out of the magazine. If voucher magazine has only one voucher drive, the voucher magazine may be used for Last In, First Out (LIFO) type voucher media storage and retrieval operations. If the voucher magazine includes two or more voucher drives, the voucher magazine may be used for First In, First Out (FIFO) type storage and retrieval operations. Each voucher magazine also includes a voucher storage area 712 for storage of vouchers. In operation, the voucher magazine receives voucher magazine control signals from the printer controller. In response to the control signals, the voucher magazine feeds vouchers to the printer from the voucher storage area using the magazine voucher drive. In response to the voucher magazine control signals, the voucher magazine may also receive vouchers from the print module and store the vouchers in the voucher storage area. The voucher magazine may also include one or more voucher sensors 714 used to detect the number of vouchers stored in the voucher storage area. The voucher sensors sense the quantity of vouchers stored in the voucher storage area and transmit voucher count signals to the printer controller for further processing. The voucher magazine may also include a read/write static memory 715 for semi-permanent storage of voucher information about vouchers stored in the voucher magazine.

The printer controller includes a processor 716 coupled to a main memory 718 by a system bus 720. The printer controller also includes a storage memory 722 coupled to the processor by the bus. The storage memory stores programming instructions 113, executable by the processor to implement the features of a multi-media printer. The storage memory also includes printer and voucher information 724 stored and used by the processor. The printer and voucher information includes information received by the printer controller about the status of the print module and voucher magazine and also about the status and identity of any vouchers stored in the voucher magazines or being operated on by the print module. The types of status information may include an image of a last printed voucher as scanned by the optical scanning device and the current status, such as millimeters of advancement, of a voucher currently in the print module.

The printer controller also includes an Input/Output (I/O) device 726 coupled to the processor by the system bus. The I/O device is used by the printer controller to transmit control signals to the print module and the voucher magazine. The I/O device may also be used by the printer controller to receive security feature and status signals from the print module and voucher magazine.

One or more communications devices 728 may be coupled to the system bus for use by the printer controller to communicate with a cashless gaming system host 102 or a game controller 108 (both of FIG. 1). The printer controller uses the communication devices to receive commands, program instructions, and voucher information from the external devices. In addition, the printer controller may use the communication devices to transmit printer status information to the external devices. Other communication devices may also be used by the printer controller to couple in a secure fashion over a local area network 732 for administrative or other purposes.

Additional communication devices and channels may be provided for communication with other peripheral devices as needed. For example, one communication device may be provided with a local communications port, accessible from an exterior of a gaming machine hosting the multi-media printer, that a technician may use to communicate with the printer controller during servicing using an external controller 730. The external controller may communicate with the printer controller using an infrared link, other short-range wireless communication link, are a hard link with an external connector in a secure manner.

In operation, the processor loads the programming instructions into the main memory and executes the programming instructions to implement the features of a multi-media printer as described herein.

As illustrated, the printer controller is shown as being electronically coupled to the print module and voucher magazine without any mechanically coupling. The printer controller may be mounted in a variety of ways and may be incorporated into various components of either the multi-media printer or the game hosting the multi-media printer. For example, the printer controller may be attached to and supported by the print module, the voucher magazine, or the host game as may be required to mechanically integrate the multi-media printer into the host game.

In one embodiment of a multi-media printer in accordance with an exemplary embodiment of the present invention, the multi-media printer does not have a modular architecture. Instead, the print module and voucher magazine are of unitary construction.

Figure 7A:
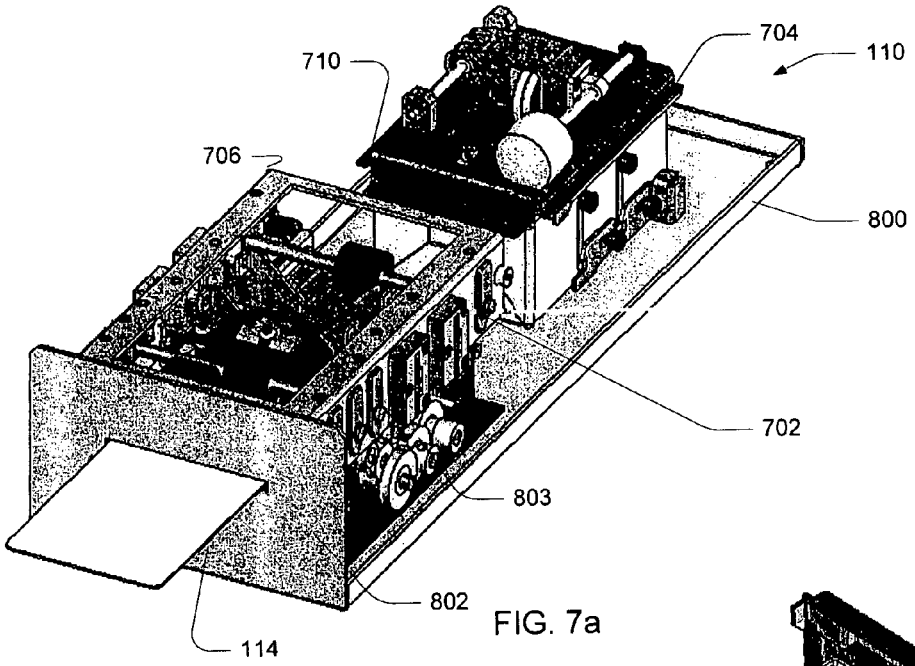
FIG. 7*a* is an isometric view of a multi-media printer in accordance with an exemplary embodiment of the present invention.

FIG. 7*a* is an isometric view of a multi-media printer in accordance with an exemplary embodiment of the present invention. As illustrated, the multi-media printer 110 includes a print module 702 and one or more voucher magazines 704 mechanically coupled on a base 800. The multi-media printer includes a front bezel 802 through which a voucher 114 may be fed by the print module's print voucher drive 706, either into or out of the multi-media printer as previously described. The voucher magazine is positioned on the base such that the voucher magazine's magazine voucher drive 710 may feed vouchers to and receive vouchers from the print module as previously described. The print module and the magazine drive are separately mounted to the base and each may separately serviced in the field without affecting the operation of the other. In addition, each component may be removed from the multi-media printer and replaced without removing the power to the multi-media printer.

The print module further includes an articulating print head mounting mechanism 803. The mechanism is used to adjust for differences in voucher media thickness. The mechanism automatically adjusts the print head to a required height dictated by the thickness of the media. When a voucher is inserted into the print module by a user, the mechanism is held at a distance from the media by the printer controller 606 (of FIG. 5) until the type of media is identified. This avoids damaging the voucher media and the print head mounting mechanism by avoiding contact between the print head and the media. Once the media type is determined, the printer controller allows the mechanism to position the print head onto the voucher media if printing is required.

As the print module and voucher magazine are separately mounted and controllable, the orientation of the print module and voucher magazine may be altered as needed to suit the mechanical requirements of a host game. For example the distance between the print module and the voucher magazine may be altered in order to accommodate a shorter printer bay included in a host game.

Figure 7B:
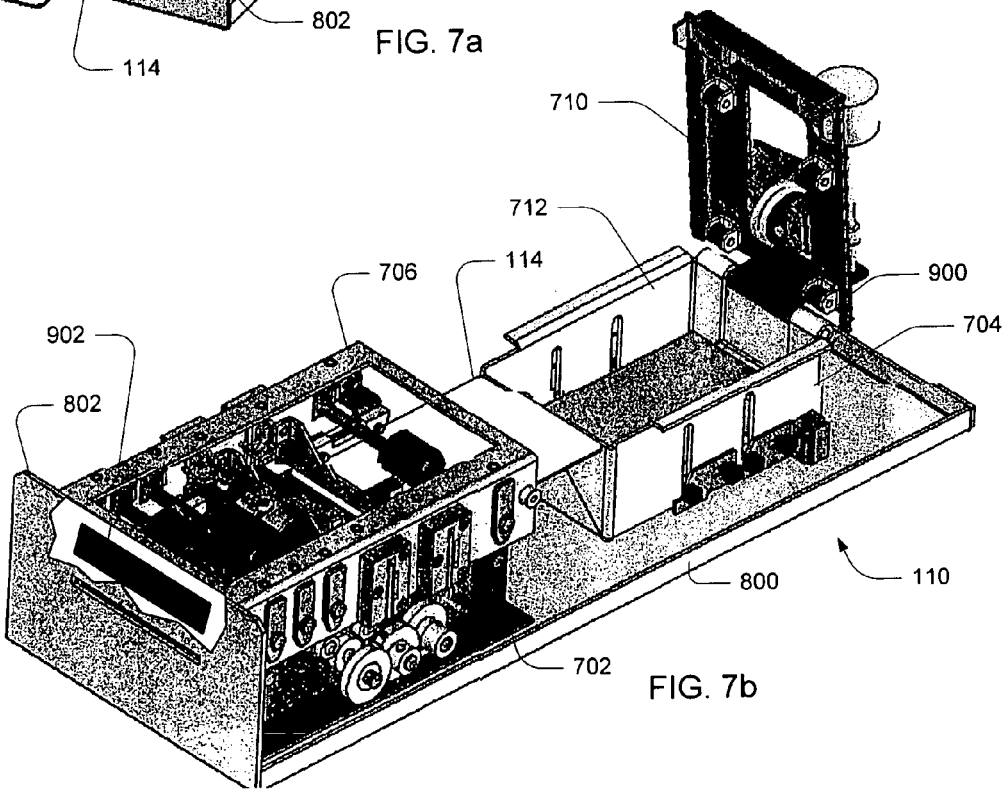
FIG. 7*b* is an isometric view of a multi-media printer with the voucher magazine opened in accordance with an exemplary embodiment of the present invention.

FIG. 7*b* is an isometric view of a multi-media printer with the voucher magazine opened in accordance with an exemplary embodiment of the present invention. As illustrated, the multi-media printer 110 includes a print module 702 and one or more voucher magazines 704 mechanically coupled on a base 800. The multi-media printer includes a front bezel 802 through which a voucher 114 may be fed by the print module's print voucher drive 706, either into or out of the multi-media printer, as previously described. The voucher magazine is positioned on the base such that the voucher magazine's magazine voucher drive 710 may feed vouchers to and receive vouchers from the print module as previously described. The magazine voucher drive is removably coupled to the voucher storage area 712 by a hinge 900 such that the magazine may be opened to allow access to the voucher storage area.

A cleaning device 902 (shown through a cutaway in the front bezel 802) is attached to the print module such that incoming vouchers are cleaned before they enter the print module. The cleaning device may include flexible solid or bristled wiper elements that contact the voucher as it is taken into the print module. The wiper elements may be conductive so as to remove static surface charges from the voucher as it moves in the multi-media printer. The wiper elements may also be charged so as to electrically attract and collect particles of dust and dirt from the voucher. As the print module's print voucher drive is reversible, the incoming voucher may be passed repeatedly, back and forth, through the cleaning element as needed.

In other print modules in accordance with other exemplary embodiments of the present invention, the cleaning device may be located within the print module, within the voucher magazine, or between the print module and a voucher magazine. In other multi-media printers in accordance with exemplary embodiments of the present invention, the cleaning device is a separate device and not integrated with either a print module or a voucher magazine. Instead, the cleaning device is a separate motorized device similar to a voucher magazine and is electronically coupled to a printer controller.

In another multi-media printer in accordance with an exemplary embodiment of the present invention, the multi-media printer contains a cleaning system used to clean the print head and thermal reversible, smart card, or write once media. The cleaning system may be internal to the multi-media printer or may be a removable cartridge that can be placed in the multi-media printer for cleaning then removed after cleaning is complete.

In one multi-media printer in accordance with an exemplary embodiment of the present invention, blank voucher media is stored as a continuous strip of fanfold or ribbon material and is cut to length by the multi-media printer as needed. The material may include perforations at predetermined locations so that the voucher size may be controlled independently of the multi-media printer.

Figure 8:
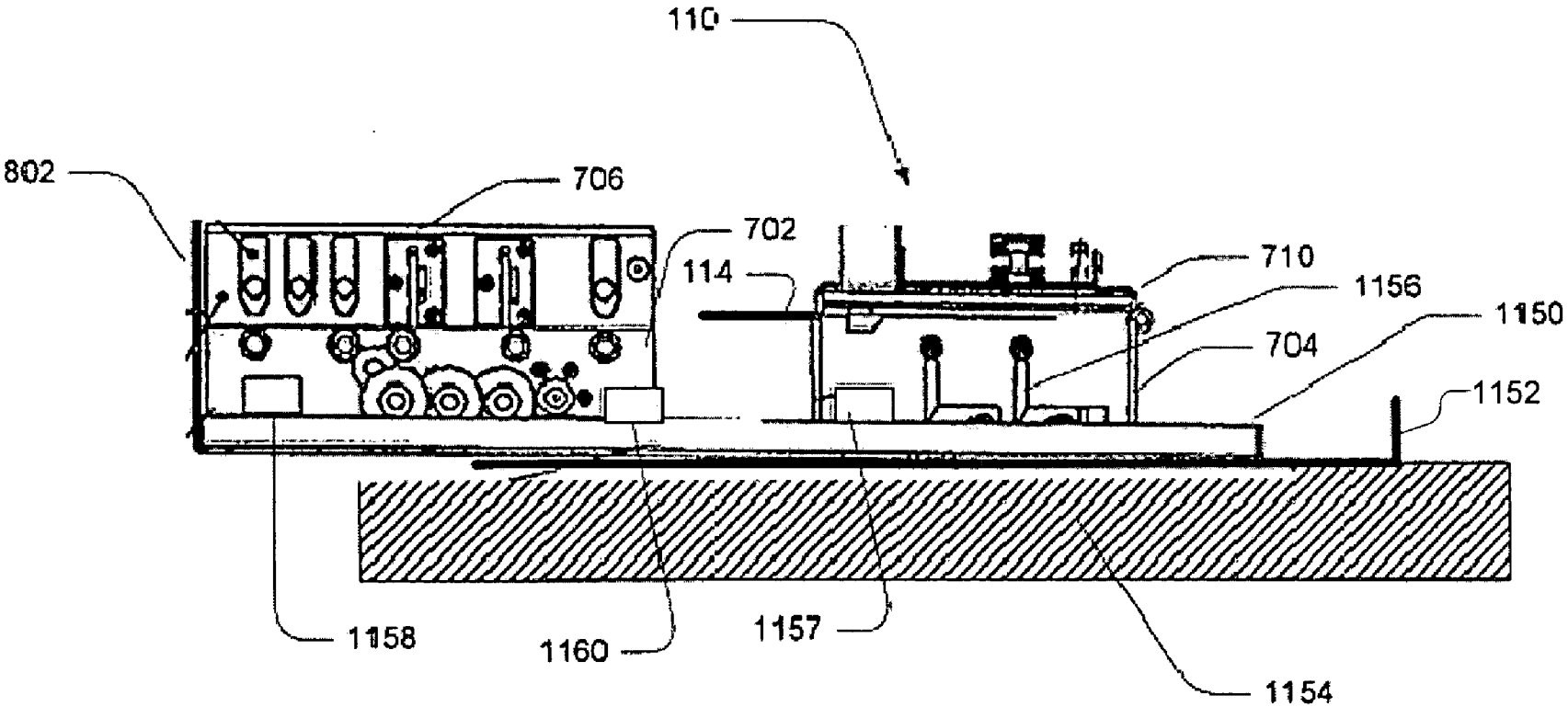
FIG. 8 is side elevation view of a multi-media printer slidably coupled to a gaming machine in accordance with an exemplary embodiment of the present invention.

FIG. 8 is side elevation view of a multi-media printer slidably coupled to a gaming machine in accordance with an exemplary embodiment of the present invention. The multi-media printer 110 includes a print module 702 and a voucher magazine 704 mechanically coupled to a printer base 1150. The multi-media printer includes a front bezel 802 through which a rewritable card may be fed by the print module's print voucher drive 706, either into or out of the multi-media printer as previously described. Voucher magazine 704 is positioned on the base such that the voucher magazine's magazine voucher drive 710 may feed vouchers 114 to and receive vouchers from the print module as previously described.

The printer base is further slidably coupled to a base plate 1152 that is fixedly coupled to a portion 1154 of a gaming machine hosting the printer. The multi-media printer may be accessed while still in the gaming machine by sliding the multi-media printer out of the gaming machine. The voucher magazine may be mechanically coupled to the printer base by a quick disconnect 1156 so that the voucher magazine may be easily removed. To facilitate easy removal, the voucher magazine may be coupled to the printer controller 606 (of FIG. 5) by a quick disconnect electrical connector

1157 that allows the voucher magazine to be installed, removed, or exchanged without removing the power to the gaming machine or multi-media printer.

The print module may be mechanically coupled to the printer base by a quick disconnect 1158 so that the print module may be easily removed. To further facilitate easy removal, the print magazine may be coupled to the printer controller 606 (of FIG. 5) by a quick disconnect electrical connector 1160 that allows the print module to be installed, removed, or exchanged without removing the power to the gaming machine or multi-media printer.

In one embodiment of a voucher magazine, the voucher magazine is slidably coupled to the printer base separately from the print module. In this embodiment, the voucher magazine may accessed by sliding the voucher magazine past the print module so that the voucher magazine may be separately serviced.

Figure 9:
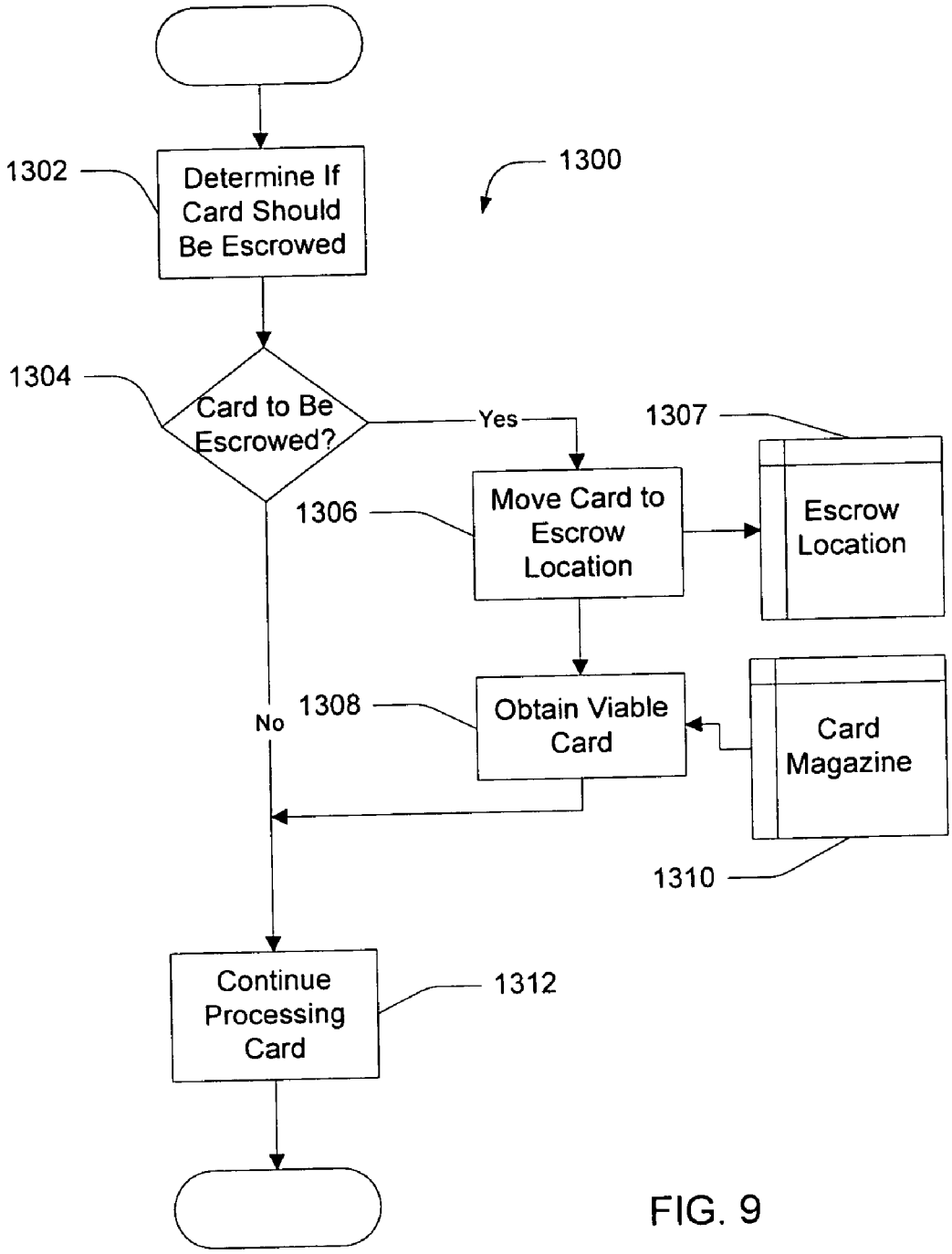
FIG. 9 is a process flow diagram of a voucher escrowing process used by a multi-media printer in accordance with an exemplary embodiment of the present invention.

FIG. 9 is a process flow diagram of a voucher escrowing process used by a multi-media printer in accordance with an exemplary embodiment of the present invention. In a voucher escrowing process 1300, a multi-media printer determines if a voucher should be removed from service. A voucher may be removed from service for a variety of reasons. Rewritable vouchers may have a finite number of erase and write cycles and so must be removed from service as they age. A voucher may become damaged so that it is no longer operable within multi-media printer or a voucher using write once media may be completely filled. A card may also have physical features such as embossing that may require the voucher to be handled in a special manner. As the multi-media printer includes an optical scanner and can verify if a voucher was printed properly immediately after printing the voucher, the multi-media printer may determine that a voucher was printed in error and may escrow the voucher. In addition, the multi-media printer may receive an identifier for a voucher to be removed from service. In which case, the security feature in the voucher may be readable but correspond to a voucher to be removed from service. Another reason a voucher may be escrowed is that the user is exchanging one kind of voucher for another kind of voucher.

Vouchers may be removed from service by moving the voucher into an escrow location within the multi-media printer by either a magazine voucher drive or by a print voucher drive. In the escrow process, the voucher determines (1302) if a voucher should be removed from service. If the multi-media printer determines that the voucher should remain in service (1304), the voucher continues processing (1306) the voucher. Otherwise, the multi-media printer moves (1306) the voucher to an escrow location 1307 within the multi-media printer and obtains (1308) a replacement voucher from a voucher magazine 1310 and continues processing (1312) the newly obtained voucher.

Figure 10:
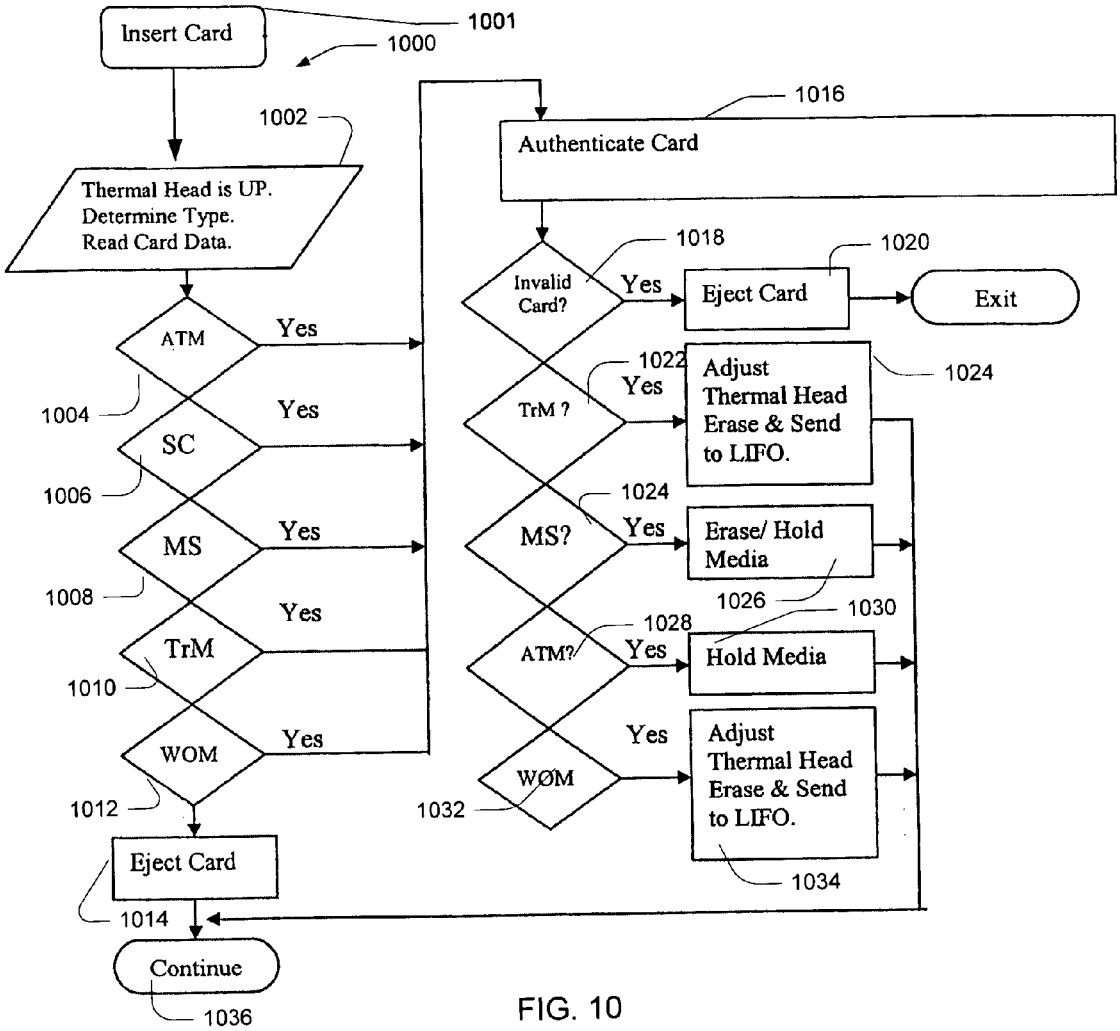
FIG. 10 is a process flow diagram of a voucher handling process in accordance with an exemplary embodiment of the present invention.

FIG. 10 is a process flow diagram of a voucher handling process in accordance with an exemplary embodiment of the present invention. A voucher handling process 1000 is used by a multi-media printer to manage a voucher that is inserted into the multi-media printer. To initiate a voucher handling process, a player inserts (1001) a voucher or card into the multi-media printer. The multi-media printer raises (1002) the thermal print head 604 (of FIG. 5) up so as not to damage the inserted voucher or card while the multi-media printer determines the type of the inserted media.

The multi-media printer determines (1004) if the inserted media is an ATM type credit card using a sensor such as an embossing detector 709 (of FIG. 6). If the inserted media is not an ATM type card, the multi-media printer determines (1006) if the inserted media is a smart card by trying to read data from the inserted media using the static memory read/write connector 622 (of FIG. 5). If the inserted media is not a smart card, the multi-media printer determines (1008) if the inserted media includes a magnetic strip by trying to read data from the inserted media using the magnetic strip read/write head 607 (of FIG. 5). If the inserted media does not include a magnetic strip, the multi-media printer determines (1010) if the inserted media is thermally rewritable by using the media thickness sensor 630 (of FIG. 5). If the inserted media is not thermally rewritable, the multi-media printer determines (1012) if the inserted media is write once media by using the media thickness sensor. If the multi-media printer cannot determine the type of the inserted media, then the multi-media printer ejects (1014) the card and continues processing (1036) any additional cards presented by a user.

If the multi-media printer can identify the media type of the inserted voucher or card, the multi-media printer reads voucher information stored on the voucher. The multi-media printer transmits the voucher information to a gaming machine 106 or a host system 102 (both of FIG. 1) for authentication (1016). If the results of the authentication indicate that the voucher or card is invalid (1018), then the voucher or card is ejected 1020 and the multi-media printer terminates processing of the card.

If the multi-media printer determines (1022) the inserted media is thermally reversible, the multi-media printer adjusts (1024) the thermal erase and print heads for continuing (1036) operations on the inserted voucher or card as may be required. The operations may include erasing the inserted voucher or card and storing the erased card in a LIFO or FIFO voucher magazine.

If the multi-media printer determines (1024) the inserted media includes a magnetic strip, the multi-media printer holds (1026) the inserted voucher or card for continuing (1036) operations as may be required. The operations may include erasing the inserted voucher or card and storing the erased card in a LIFO or FIFO voucher magazine for later use.

If the multi-media printer determines (1028) the inserted media is an ATM style credit card, the multi-media printer holds (1030) the inserted voucher or card for continuing (1036) operations as may be required. The operations may include reading the inserted voucher or card for further processing.

If the multi-media printer determines (1032) the inserted media is write once thermal media, the multi-media printer adjusts (1034) the thermal erase and print heads for continuing (1036) operations on the inserted voucher or card as may be required. The operations may include overwriting a last written writable zone, such as writable zone 228 (of FIG. 3*c*) on an inserted voucher or card and storing the overwritten card in a LIFO or FIFO voucher magazine for later use.

Figure 11:
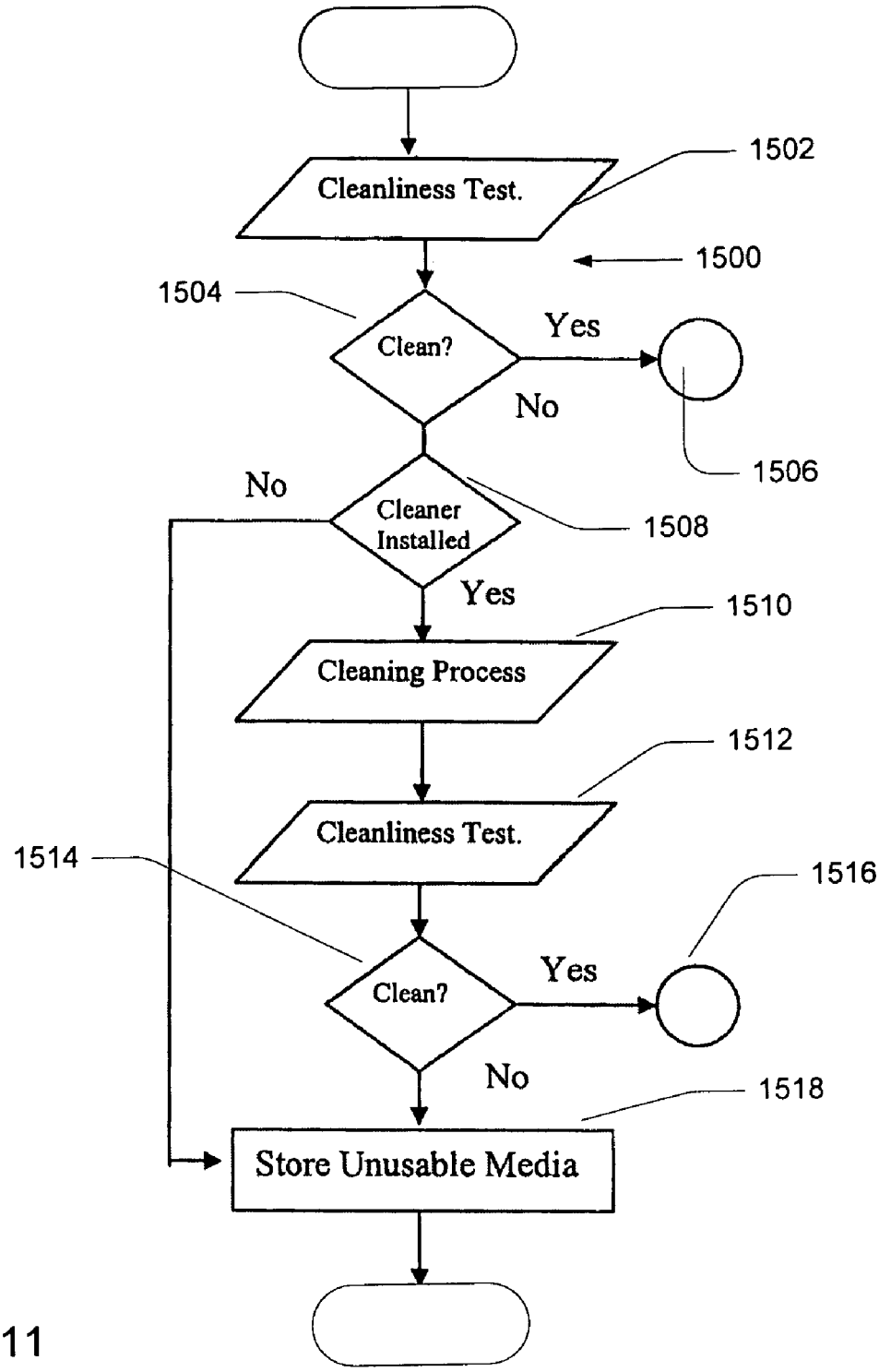
FIG. 11 is a process flow diagram of a voucher cleaning process in accordance with an exemplary embodiment of the present invention.

FIG. 11 is a process flow diagram of a voucher media cleaning process in accordance with an exemplary embodiment of the present invention. A multi-media printer uses a voucher media cleaning process 1500 to determine the cleanliness of a voucher or card and to clean the voucher or card before using the voucher or card. The multi-media printer determines (step 1004 to step 1012 of FIG. 10), if the voucher or card is composed of a media that may be cleaned, such as a rewritable thermal media. If so, the multi-media performs a cleanliness test (1502) on the voucher or card. A cleanliness test may be performed using the optical scanning device 605 (of FIG. 5) by measuring the optical characteristics of non-printed printed portions of the voucher or card.

If the multi-media printer determines that the card is clean (1504) the multi-media printer continues (1506) processing the voucher or card as required. If the voucher or card is not clean, the multi-media printer determines (1508) if a cleaning device 902 (of FIG. 8) is installed in the multi-media printer. If not, the multi-media printer stores (1518) the voucher or card to remove the unusable media from service. The if the cleaner is installed, the multi-media printer cleans (1510) the voucher or card as previously described. The multi-media printer then performs (1512) another cleanliness test as previously described. The multi-media printer then determines (1514) if the second cleanliness test indicates that the voucher or card was successfully cleaned. If so, the multi-media printer continues (1516) processing the voucher or card as required. If not, the multi-media printer stores (1518) the voucher or card to remove the unusable media from service.

Although this invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supported by this application and the claims' equivalents rather than the foregoing description.

What is claimed is:

1. A multi-media gaming printer comprising:

a print module comprising:

two or more heads, each head for reading and writing a different type of card, the two or more heads selected from the group including a thermal card read/write head comprising a thermal write head and an optical read head, a magnetic strip card read/write head, and a smart card connector;

a single media drive adapted to couple a card inserted into the multi-media gaming printer to each of the heads; and a controller coupled to the two or more heads and the single media drive, the controller adapted to manipulate the inserted card using the capabilities of the two or more heads;

a media cleaner; and a media cleanliness interrogator.

2. A multi-media gaming printer comprising a print module comprising:

two or more heads, each head for reading and writing a different type of card, the two or more heads selected from the group including a thermal card read/write head comprising a thermal write head and an optical read head, a magnetic strip card read/write head, and a smart card connector; and a single articulated media drive adapted to couple a card inserted into the multi-media gaining printer to each of the heads; and a controller coupled to the two or more heads and the single media drive, the controller adapted to manipulate the inserted card using the capabilities of the two or more heads; and an embossing sensor, the controller further adapted to retract one or more of the heads away from the inserted card using the articulated media drive if embossing is detected.

3. A multi-media gaming printer comprising:

a print module for manipulating cards comprising different types of media, the print module comprising:

a first head for manipulating a first type of card;

a second head for manipulating a second type of card, the first type of card and the second type of card being different card types; and a single media drive adapted to couple a card inserted into the multi-media gaming printer to each of the heads;

a cleaner for cleaning media inserted into the gaming multi-media printer;

a sensor for determining the cleanliness of media inserted into the gaming multi-media printer; and a controller for controlling the print module, the controller adapted to manipulate the inserted card using the heads.

4. A multi-media gaming printer comprising:

a print module for manipulating cards comprising different types of media, the print module comprising:

a first head for manipulating a first type of card;

a second head for manipulating a second type of card, the first type of card and the second type of card being different card types; and a single articulated media drive adapted to couple a card inserted into the multi-media gaining printer to each of the heads and to accommodate media with various thicknesses;

a sensor for sensing embossing on a card inserted into the multi-media gaming printer a controller for controlling the print module, the controller adapted to manipulate an inserted card using the heads and to retract one or more of the heads away from the inserted card using the articulated media drive if embossing is detected.

5. The multi-media gaining printer of any of claims 3 and 4, the second head selected from the group including a magnetic strip card read/write head and a smart card connector.

* * * * *